US012006124B2

(12) United States Patent
Staheli

(10) Patent No.: US 12,006,124 B2
(45) Date of Patent: Jun. 11, 2024

(54) PAPER SHIPPING ENVELOPE WITH PUNCHED PAPER STAND-OFF PADDING

(71) Applicant: Intertape Polymer Corp., Sarasota, FL (US)

(72) Inventor: Clinton Charles Staheli, Sarasota, FL (US)

(73) Assignee: Intertape Polymer Corp., Sarasota, FL (US)

( * ) Notice: Subject to any disclaimer, the term of this patent is extended or adjusted under 35 U.S.C. 154(b) by 0 days.

(21) Appl. No.: 17/960,909

(22) Filed: Oct. 6, 2022

(65) Prior Publication Data

US 2023/0116448 A1 Apr. 13, 2023

Related U.S. Application Data

(60) Provisional application No. 63/253,319, filed on Oct. 7, 2021.

(51) Int. Cl.
*B65D 81/03* (2006.01)
*B65D 81/05* (2006.01)

(52) U.S. Cl.
CPC ..... *B65D 81/03* (2013.01); *B65D 81/051* (2013.01)

(58) Field of Classification Search
CPC ..... B65D 81/133; B65D 81/127; B65D 81/3869; B65D 81/03; B65D 27/00; B65D 65/406; B31B 2170/20; B31B 2155/002
USPC ..... 206/522, 521; 383/109; 229/68.1, 403, 229/87.02
See application file for complete search history.

(56) References Cited

U.S. PATENT DOCUMENTS

| | | | | |
|---|---|---|---|---|
| 3,144,979 | A * | 8/1964 | Young | B65D 5/0227 229/101 |
| 5,544,473 | A * | 8/1996 | Maida | B65D 81/03 229/928 |
| 7,108,650 | B2 * | 9/2006 | Marzano | B65D 81/03 156/263 |
| 2006/0113360 | A1 * | 6/2006 | Bartlett | B32B 27/08 206/523 |
| 2014/0154477 | A1 * | 6/2014 | Chu | B32B 27/32 428/178 |
| 2019/0100369 | A1 * | 4/2019 | Hoffman | B65D 65/406 |

* cited by examiner

*Primary Examiner* — King M Chu
(74) *Attorney, Agent, or Firm* — K&L Gates LLP

(57) ABSTRACT

A padded mailer includes an outer shipping pocket, having a first opening, and an inner shipping pocket, having a second opening. The inner shipping pocket is disposed within the outer shipping pocket at the first opening. The inner shipping pocket includes a plurality of standoffs disposed away from an outer surface of the inner shipping pocket and towards an inner surface of the outer shipping pocket.

16 Claims, 7 Drawing Sheets

PAPER SHIPPING ENVELOPE WITH PUNCHED PAPER STAND-OFF PADDING

PRIORITY CLAIM AND CROSS-REFERENCE TO RELATED APPLICATIONS

This application claims priority to and the benefit of U.S. Provisional Patent Application No. 63/253,319, filed Oct. 7, 2021, titled PAPER SHIPPING ENVELOPE WITH PUNCHED PAPER STAND-OFF PADDING, the entire contents of which are incorporated by reference herein in their entirety and relied upon.

FIELD

The present disclosure relates generally to curbside recyclable, padded paper mailer envelopes with punched paper stand-off padding. More specifically, this disclosure relates to premade pre-sized padded paper envelopes, and related padded paper mailer envelope material that is curbside recyclable and can be made-to-fit inline to the dimensions of the packaged item in at least one dimension, including methods of manufacturing punched paper stand-off padding.

BACKGROUND

Padded paper envelopes are typically constructed by sandwiching three layers of paper, in order to form an outer wall of the envelope. For example, three-layer walled envelopes may include smooth paper inner and outer layers with a geometric intermediate padding layer, such as fluted paper, expanded paper, or honeycomb paper. This intermediate layer provides cushioning for whatever is stored within the inner layer (e.g., for protection during shipment).

Often, stuffing these envelopes can be difficult because items to-be-shipped can snag or tear the geometric intermediate padding layer during packing, thus reducing the cushioning functionality of this intermediate layer. These envelopes may additionally require an inner solid paper layer in order to create a smooth surface, so that the envelope can be stuffed without snagging or tearing the intermediate padding layer. However, the use of an inner solid paper layer increases cost of production and waste.

Improved padded paper envelopes with two-layer walls, and related methods of manufacturing improved padded paper envelopes, are therefore needed.

SUMMARY

The curbside recyclable, padded paper mailer envelopes with punched paper stand-off padding disclosed herein improve on current padded paper mailer envelope technology by creating a two-layer wall with a smooth inner surface while providing intermediate padding via punched standoffs. This two-layer wall advantageously provides a smooth inner surface that reduces snagging and tearing during item insertion and extraction, thus improving mailer assembly and reducing production costs and waste.

In light of the disclosure herein, and without limiting the scope of the invention in any way, in a first aspect of the present disclosure, which may be combined with any other aspect listed herein unless specified otherwise, a padded mailer includes an outer shipping pocket, having a first opening, and an inner shipping pocket, having a second opening. The inner shipping pocket is disposed within the outer shipping pocket at the first opening. The inner shipping pocket includes a plurality of standoffs disposed away from an outer surface of the inner shipping pocket and towards an inner surface of the outer shipping pocket.

In a second aspect of the present disclosure, which may be combined with any other aspect listed herein unless specified otherwise, the outer shipping pocket is coupled to the inner shipping pocket.

In a third aspect of the present disclosure, which may be combined with any other aspect listed herein unless specified otherwise, the outer shipping pocket and inner shipping pocket are coupled by an adhesive coating.

In a fourth aspect of the present disclosure, which may be combined with any other aspect listed herein unless specified otherwise, the adhesive coating is activated by heat.

In a fifth aspect of the present disclosure, which may be combined with any other aspect listed herein unless specified otherwise, the adhesive coating is repulpable for purposes of curbside recyclability.

In a sixth aspect of the present disclosure, which may be combined with any other aspect listed herein unless specified otherwise, the outer shipping pocket and the inner shipping pocket are comprised of curbside recyclable paper.

In a seventh aspect of the present disclosure, which may be combined with any other aspect listed herein unless specified otherwise, the inner shipping pocket includes an inner surface that is smooth and includes a plurality of holes formed by the plurality of standoffs.

In an eighth aspect of the present disclosure, which may be combined with any other aspect listed herein unless specified otherwise, the inner shipping pocket is formed of a single piece of paper having the plurality of standoffs, such that the single piece of paper is folded along a bottom edge and sealed along a left edge and a right edge, and such that the second opening is formed along a top edge.

In a ninth aspect of the present disclosure, which may be combined with any other aspect listed herein unless specified otherwise, the outer shipping pocket is formed of a single piece of paper, such that the single piece of paper is folded along a bottom edge and sealed along a left edge and a right edge, and such that the first opening is formed along a top edge.

In a tenth aspect of the present disclosure, which may be combined with any other aspect listed herein unless specified otherwise, the plurality of standoffs are disposed along the inner shipping pocket in an array.

In an eleventh aspect of the present disclosure, which may be combined with any other aspect listed herein unless specified otherwise, the plurality of standoffs are formed by piercing through the inner shipping pocket.

In a twelfth aspect of the present disclosure, which may be combined with any other aspect listed herein unless specified otherwise, a shipping item is disposed within the inner shipping pocket.

In a thirteenth aspect of the present disclosure, which may be combined with any other aspect listed herein unless specified otherwise, the outer shipping pocket includes a sealable flap, such that the first opening is configured to be sealed close.

In a fourteenth aspect of the present disclosure, which may be combined with any other aspect listed herein unless specified otherwise, a method of constructing a padded mailer includes receiving a single sheet of paper and punching a plurality of standoffs into the single sheet of paper. The method includes forming an inner shipping pocket with the single sheet of paper, and disposing the inner shipping pocket inside of an outer shipping pocket.

In a fifteenth aspect of the present disclosure, which may be combined with any other aspect listed herein unless specified otherwise, the method further includes deforming the plurality of standoffs after the plurality of standoffs have been punched.

In a sixteenth aspect of the present disclosure, which may be combined with any other aspect listed herein unless specified otherwise, the plurality of standoffs are disposed along the inner shipping pocket in an array.

In a seventeenth aspect of the present disclosure, which may be combined with any other aspect listed herein unless specified otherwise, the plurality of standoffs are all punched into the single sheet of paper in a first direction.

In an eighteenth aspect of the present disclosure, which may be combined with any other aspect listed herein unless specified otherwise, the inner shipping pocket is formed of the single sheet of paper, such that the single sheet of paper is folded along a bottom edge and sealed along a left edge and a right edge, and such that an opening is formed along a top edge.

In a nineteenth aspect of the present disclosure, which may be combined with any other aspect listed herein unless specified otherwise, the method further includes disposing a shipping item within the opening of the inner shipping pocket.

In a twentieth aspect of the present disclosure, which may be combined with any other aspect listed herein unless specified otherwise, the method further includes coupling the outer shipping pocket to the inner shipping pocket.

Additional features and advantages of the disclosed devices, systems, and methods are described in, and will be apparent from, the following Detailed Description and the Figures. The features and advantages described herein are not all-inclusive and, in particular, many additional features and advantages will be apparent to one of ordinary skill in the art in view of the figures and description. Also, any particular embodiment does not have to have all of the advantages listed herein. Moreover, it should be noted that the language used in the specification has been selected for readability and instructional purposes, and not to limit the scope of the inventive subject matter.

BRIEF DESCRIPTION OF THE FIGURES

Understanding that figures depict only typical embodiments of the invention and are not to be considered to be limiting the scope of the present disclosure, the present disclosure is described and explained with additional specificity and detail through the use of the accompanying figures. The figures are listed below.

DETAILED DESCRIPTION

Figure 1:
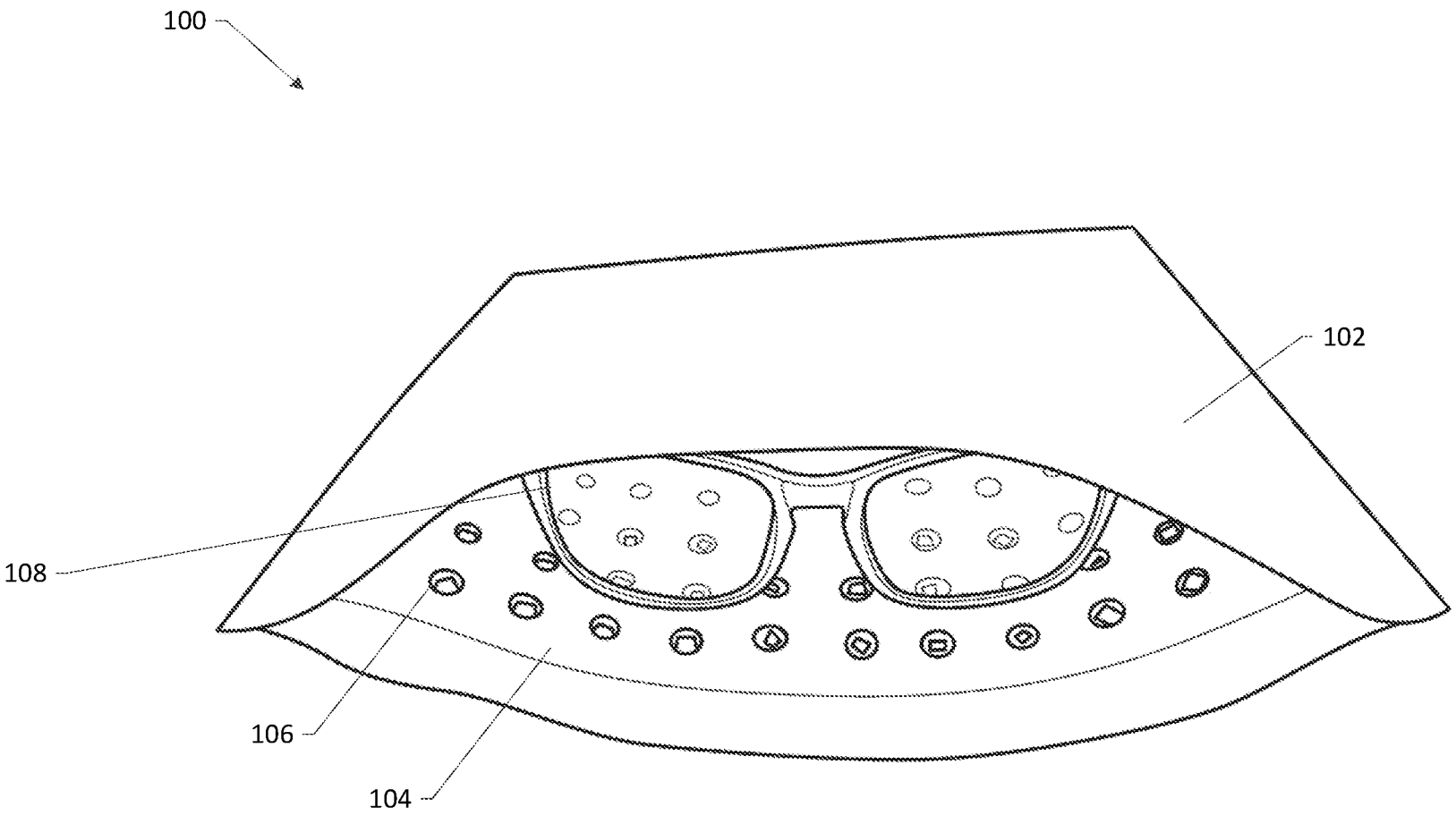
FIG. 1 illustrates a perspective view of a padded paper mailer envelope with punched paper stand-off padding, according to an example embodiment of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specific the presence of stated features, integers, steps, operations, elements, and/or components, but do not preclude the presence or additional of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent"). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

FIG. 1 illustrates a perspective view of a padded paper mailer envelope with punched paper stand-off padding. Specifically, padded mailer 100 includes an outer shipping pocket 102 and an inner shipping pocket 104. In an embodiment, the outer shipping pocket 102 and the inner shipping pocket 104 are comprised of curbside recyclable paper. Each of outer shipping pocket 102 and inner shipping pocket 104 include a respective opening.

In an embodiment, the inner shipping pocket 104 is disposed within the outer shipping pocket 102, such that the two shipping pockets collectively constitute padded mailer 100. For example, inner shipping pocket 104 is disposed within outer shipping pocket 102 at the opening of outer shipping pocket 102.

Inner shipping pocket 104 includes a plurality of standoffs 106. Each of the plurality of standoffs 106 is an individual hole or aperture formed by piercing inner shipping pocket 104. Importantly, the plurality of standoffs 106 are formed by piercing (and not by hole-punching or other cutting techniques); this ensures that each of the plurality of standoffs 106 includes material deformation beyond the aperture that is formed, as discussed in greater detail herein.

In an embodiment, the plurality of standoffs 106 are disposed away from an outer surface of the inner shipping pocket 104 towards an inner surface of the outer shipping pocket 102. Namely, for example, the plurality of standoffs 106 are all formed in a specific direction (e.g., all in the same direction, such as outwardly facing). In this way, an interior of the inner shipping pocket 104 has a smooth, yet perforated, surface; similarly, an exterior of the inner shipping pocket 104 has the plurality of standoffs 106 as raised surfaces (e.g., depth caused by the perforations themselves) and these standoffs 106 form a three-dimensional geometry on the exterior of the inner shipping pocket 104.

Thus, when the inner shipping pocket is disposed within the outer shipping pocket 102, such that the two shipping pockets collectively constitute padded mailer 100, a resulting air plenum is created by the plurality of standoffs 106. This air plenum, along with the standoffs 106 themselves, acts as functional padding between inner shipping pocket 104 and outer shipping pocket 102. At the same time, the smooth interior of inner shipping pocket 104 allows for an item 108 to be placed for shipment while avoiding snagging or tearing as it is placed within inner shipping pocket 104.

In an embodiment, outer shipping pocket 102 includes a sealable flap, such that padded mailer 100 may be readily sealed with item 108 disposed therein.

Figure 2:
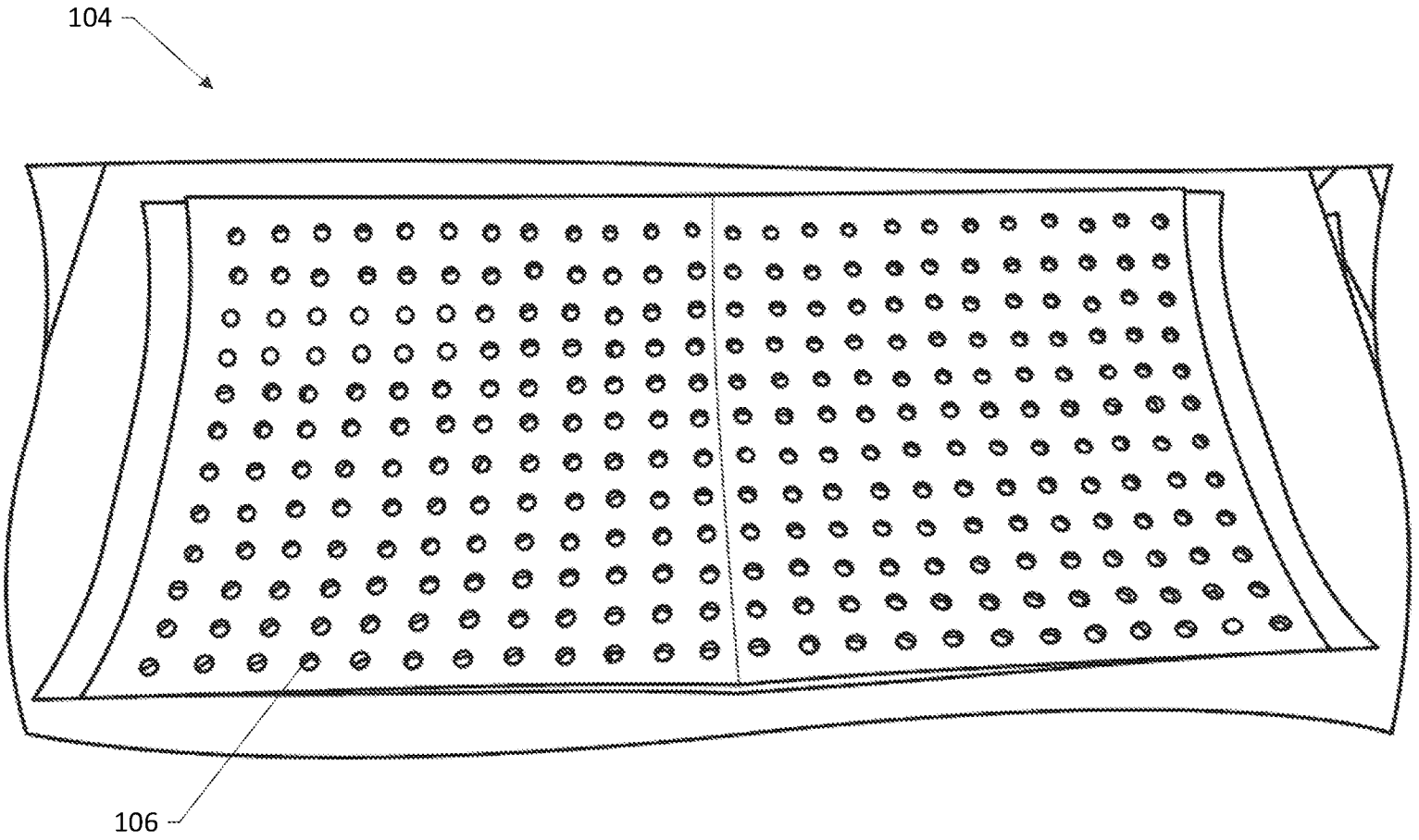
FIG. 2 illustrates a perspective view of punched paper stand-off padding, according to an example embodiment of the present disclosure.

FIG. 2 illustrates a perspective view of interior shipping pocket 104 in a flat configuration (i.e., prior to folding or formation of the pocket structure). Interior shipping pocket 104 includes the plurality of standoffs 106. In an embodiment, the plurality of standoffs 106 vary in size, but must be large enough to result in a stand-off that will provide cushioning between interior shipping pocket 104 and outer shipping pocket 102. In a preferred embodiment, the plurality of standoffs 106 are disposed along the inner shipping pocket 104 in an array (e.g., rectangular array). In other embodiments, perforation geometries and/or the specific longitudinal and latitudinal perforation patterns on the inner shipping pocket 104 may vary.

Returning to FIG. 1, each of outer shipping pocket 102 and inner shipping pocket 104 may be formed of multiple sheets or, alternatively, formed of one sheet. For example, in a multiple-sheet configuration, two sheets of inner shipping pocket 104 are sealed to one another along three sides, leaving the fourth side open, to constitute one single inner shipping pocket 104.

In a different embodiment, inner shipping pocket 104 is formed of a single piece of paper 104 having the plurality of standoffs 106, such that the single piece of paper 104 is folded along its bottom edge and sealed along its left edge and right edge. In this way, inner shipping pocket 104 includes an opening along its top edge (e.g., for receiving item 108). Similarly, for example, outer shipping pocket 102 may formed of a single piece of paper, such that the single piece of paper is folded along its bottom edge and sealed along its left edge and right edge. In this way, outer shipping pocket 102 includes an opening along its top edge (e.g., for receiving inner shipping pocket 102).

In an embodiment, outer shipping pocket 102 is coupled to the inner shipping pocket 104, such that inner shipping pocket 104 is not readily removable from outer shipping pocket 102 after coupling. For example, the outer shipping pocket 102 and inner shipping pocket 104 are coupled to one another via an adhesive coating. In an embodiment, the adhesive coating is heat-activated. In another embodiment, the adhesive coating is repulpable for purposes of curbside recyclability (e.g., the coating is made of a water soluble heat sealable polymeric coating that is sufficiently repulpable to allow for curbed recycling, such as polyvinyl alcohol (PVOH), starch-based polymers, and or other similar coatings). For example, adhesive coating may cover the entirety of outer shipping pocket 102 and inner shipping pocket 104. In an alternative embodiment, outer shipping pocket 102 and inner shipping pocket 104 are uncoated paper, but coupled together using adhesives that are applied during manufacturing.

Continuing on, FIGS. 3 to 7 generally illustrate manufacturing of and related processes for padded mailer 100.

Figure 3:
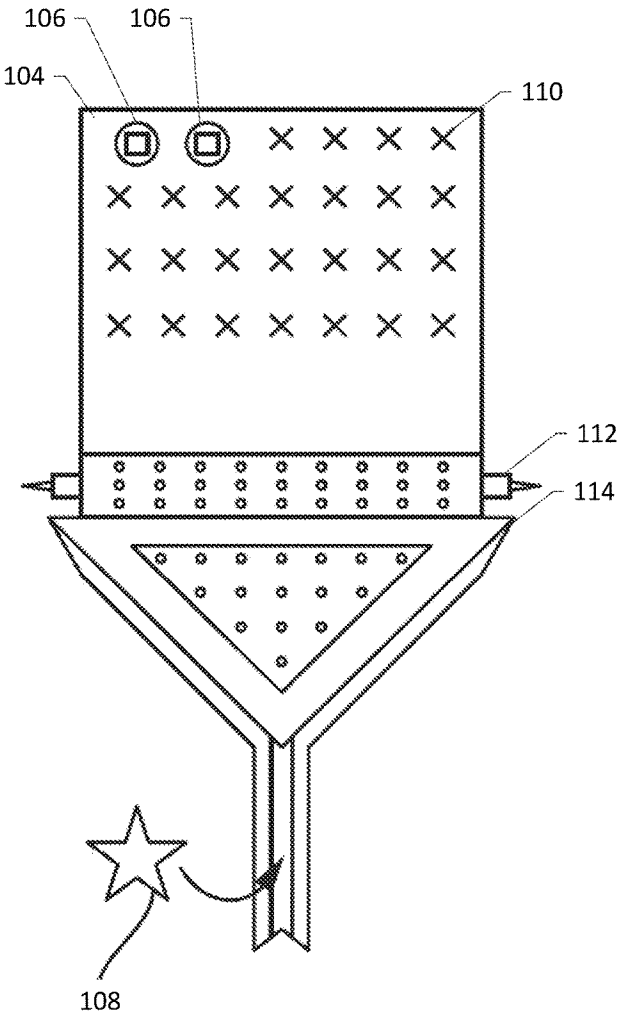
FIG. 3 illustrates a side view of a padded paper mailer envelope as constructed with automated or semi-automated manufacturing systems, according to an example embodiment of the present disclosure.

Specifically, FIG. 3 illustrates a side view of a padded mailer 100 as it is constructed with automated or semi-automated manufacturing systems. In an embodiment, padded mailer 100 is constructed with a SmartPac machine and related horizontal conveyor. For example, inner shipping pocket 104 is initially disposed in a flat sheet form (such as illustrated in FIG. 2). Inner shipping pocket 104 may include standoffs 106 and additional standoff locations 110. For example, standoff locations 110 are physical positions on inner shipping pocket 104. The manufacturing system disclosed herein is configured to pierce through inner shipping pocket 104, such that a standoff 106 is formed at each of the standoff locations 110.

Upon piercing, such that inner shipping pocket 104 includes an array of standoffs 106, the inner shipping pocket 104 can be positioned on a roll 112 (e.g., for subsequent usage or storage). Roll 112 may be positioned adjacent to a folding mechanism 114. Via folding mechanism 114, the single piece of paper 104 is cut, folded along its bottom edge and sealed along its left edge and right edge. In this way, inner shipping pocket 104 includes an opening along its top edge (e.g., for receiving item 108). Once folded, inner shipping pocket 104 may be placed inside of outer shipping pocket 102. In a different embodiment, inner shipping pocket 104 and outer shipping pocket 102 are concurrently cut and folded via folding mechanism 114. For example, inner shipping pocket 104 and outer shipping pocket 102 can be cut and folded "around" item 108, as item 108 rests on top of the flat sheet (in a pre-folded configuration).

Figure 4:
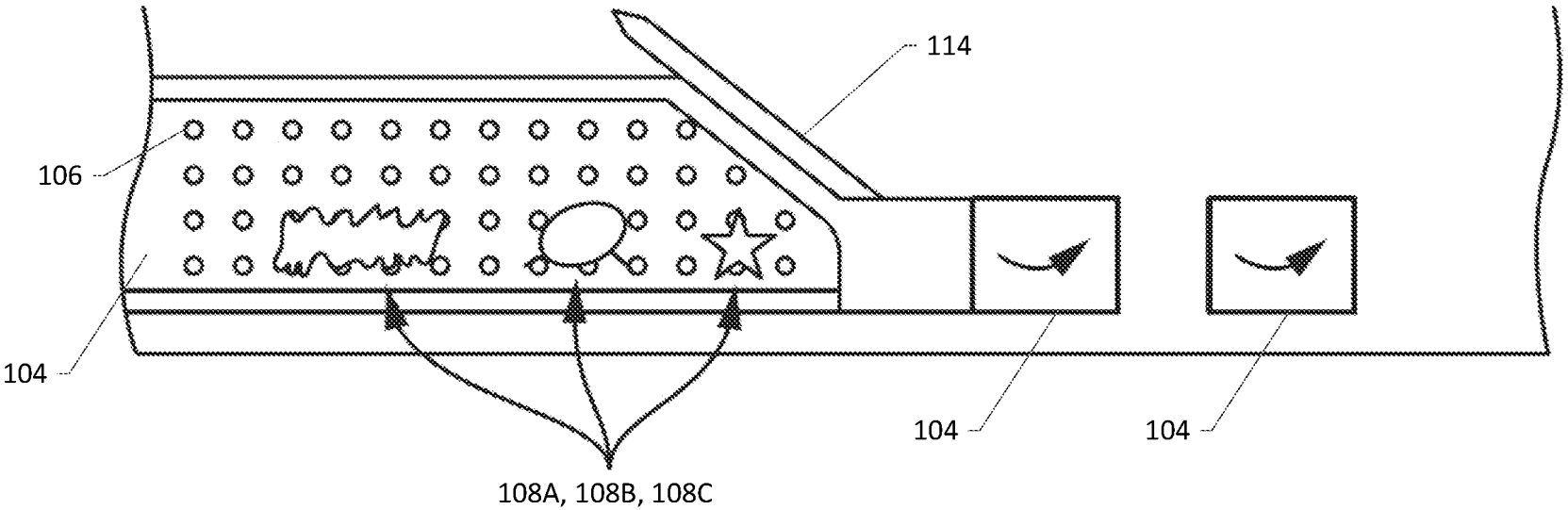
FIG. 4 illustrates a top view of a padded paper mailer envelope as constructed with automated or semi-automated manufacturing systems along with to-be-packaged items, according to an example embodiment of the present disclosure.

Similarly, FIG. 4 illustrates a top view of a padded mailer 100 as it is constructed with automated or semi-automated manufacturing systems. Inner shipping pocket 104 is initially in a flat configuration including the array of standoffs 106. A number of items 108A, 108B, 108C are disposed on flat shipping pocket 104. Via folding mechanism 114, the single piece of paper 104 is cut, folded along its bottom edge and sealed along its left edge and right edge around each of items 108A, 108B, 108C. Once folded, inner shipping pocket 104 may be placed inside of outer shipping pocket 102. In a different embodiment, inner shipping pocket 104 and outer shipping pocket 102 are concurrently cut and folded via folding mechanism 114.

Figure 5:
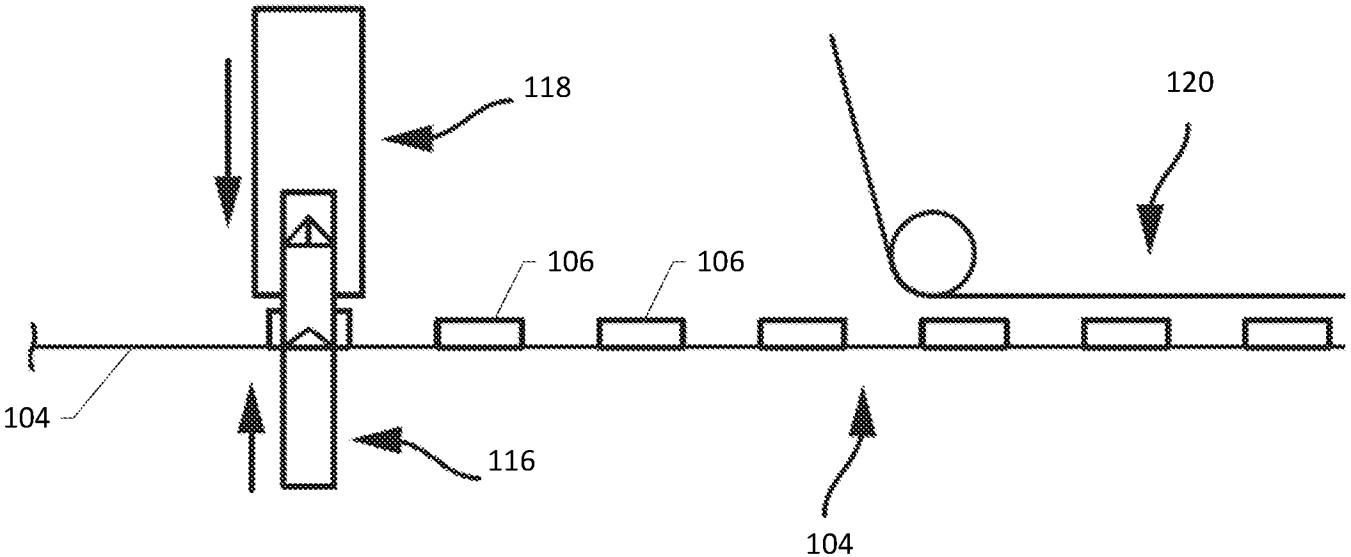
FIG. 5 illustrates a side view of a punched paper stand-off padding as constructed with automated or semi-automated manufacturing system, according to an example embodiment of the present disclosure.

FIG. 5 illustrates a side view of a punched paper stand-off 106 as being formed with automated or semi-automated manufacturing systems. For example, as noted previously, inner shipping pocket 104 is initially disposed in a flat sheet form and may include standoffs 106 and additional standoff locations 110. The manufacturing system disclosed herein is configured to pierce through inner shipping pocket 104, such that a standoff 106 is formed at each of the standoff locations 110.

In an embodiment, a punch 116 is configured to reciprocally pierce through inner shipping pocket 104 to form each of the standoffs 106. Punch 116 pierces through inner shipping pocket 104 in the same direction for each of the plurality of standoffs 106 (e.g., an upward direction as illustrated in FIG. 5). In a particular embodiment, punch 116 is configured to be received by die 118, such as a concentric aperture on die 118, once punch 116 pierces inner shipping pocket 104. Die 118 may additionally be configured to translate downward (onto standoffs 106) so as to crush and/or deform the standoff 106 after it is formed via punch 116. For example, die 118 partially crushes the standoffs 106 in a way that keeps standoffs 106 permanently folded in such a manner that they cannot be smoothed back down; this advantageously results in permanent stand-offs 106 on the inner shipping pocket 104.

Once inner shipping pocket 104 includes the standoffs 106, it may be coupled with outer shipping pocket 102. For example, outer shipping pocket 102 may be rolled adjacent to inner shipping pocket 104 via conveyor 120. The outer shipping pocket 102 and inner shipping pocket 104 may be coupled to one another via an adhesive coating, such as polyvinyl alcohol (PVOH), starch-based polymers, and or other similar coatings).

Figure 6:
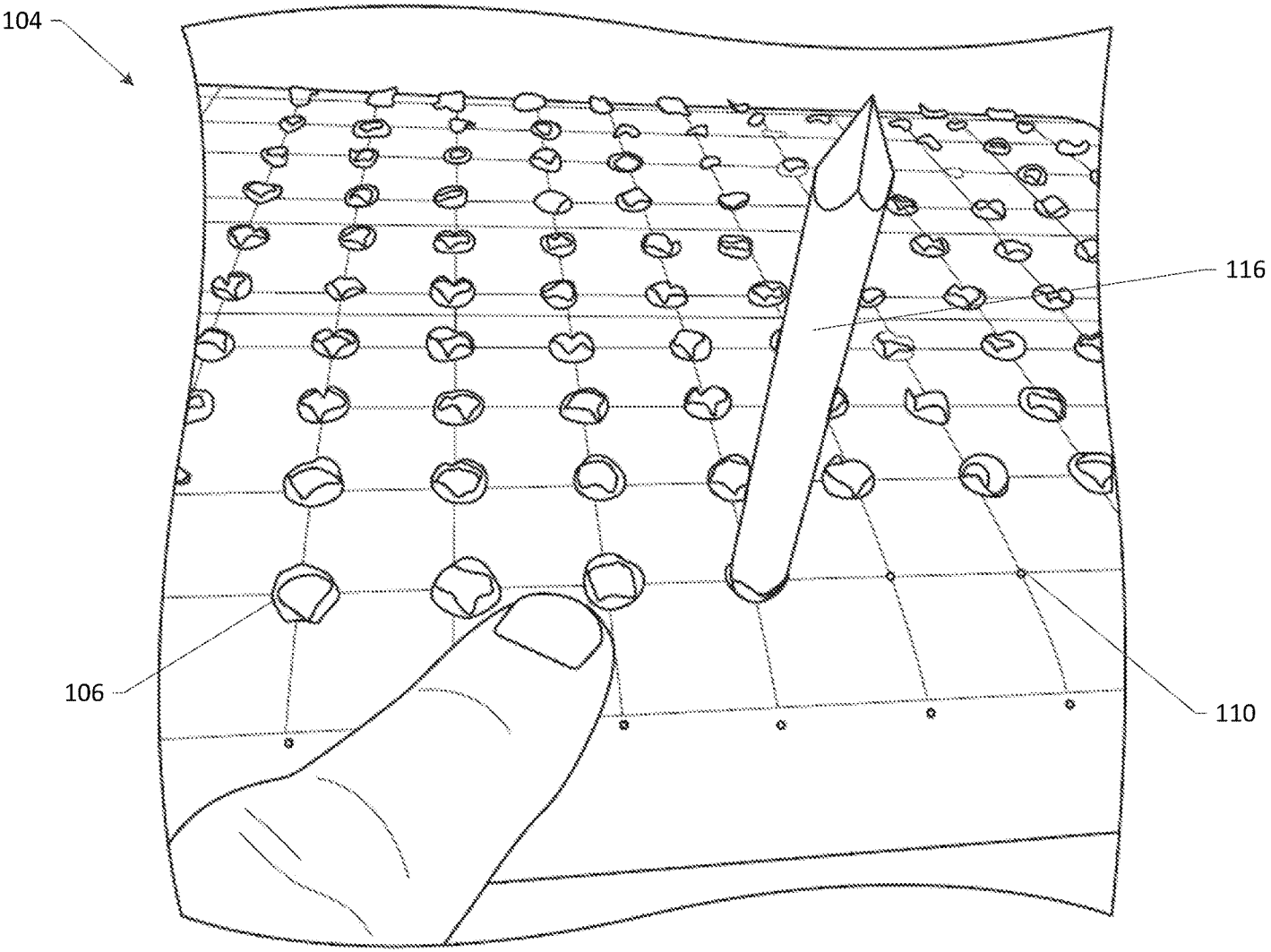
FIG. 6 illustrates a perspective view of a perforation mechanism and associated stand-offs on punched paper stand-off padding, according to an example embodiment of the present disclosure.

FIG. 6 illustrates a perspective view of punch 116 as it pierces inner shipping pocket 104. Punch 116 pierces through inner shipping pocket 104 in the same direction for each of the plurality of standoffs 106. Inner shipping pocket 104 additionally includes a number of standoff locations 110, which have yet to be pierced by punch 116.

Figure 7:
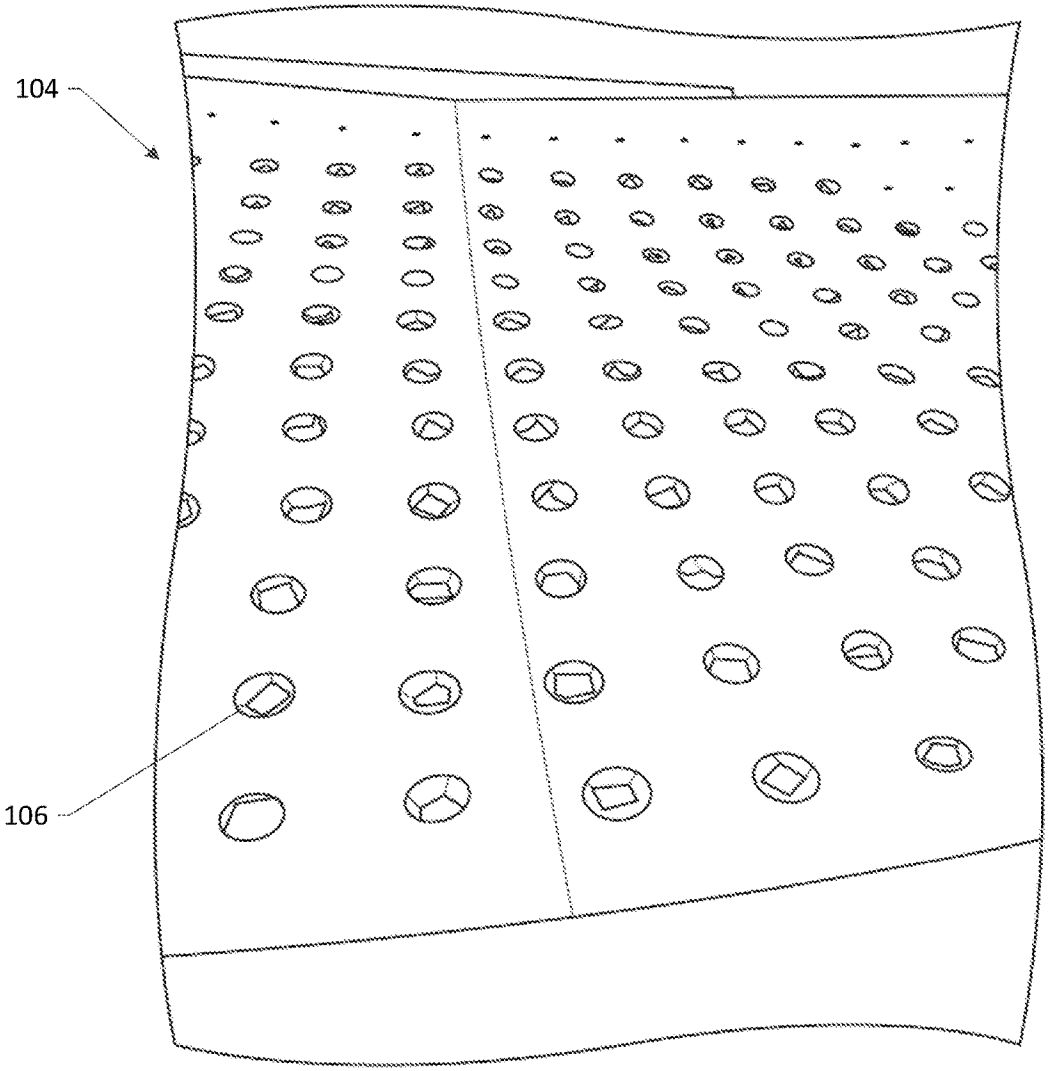
FIG. 7 illustrates a perspective view of a smooth side of punched paper stand-off padding, according to an example embodiment of the present disclosure.

FIG. 7 illustrates a perspective view of a smooth side of inner shipping pocket 104. For example, FIG. 7 illustrates the side opposite that illustrated in FIG. 6. Due to smooth side of inner shipping pocket 104, item 108 avoids snagging or tearing as it is placed within inner shipping pocket 104.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A padded mailer, comprising:

an outer shipping pocket, having a first opening; and an inner shipping pocket, having a second opening, wherein the inner shipping pocket is disposed within the outer shipping pocket at the first opening, wherein the inner shipping pocket includes a plurality of standoffs disposed away from an outer surface of the inner shipping pocket and towards an inner surface of the outer shipping pocket, wherein each of the plurality of standoffs comprises an aperture and material deformation beyond the aperture, wherein the outer shipping pocket and the inner shipping pocket are comprised of curbside recyclable paper, wherein the outer shipping pocket is coupled to the inner shipping pocket, wherein the outer shipping pocket and inner shipping pocket are coupled by an adhesive coating, and wherein the adhesive coating is activated by heat.

2. The padded mailer of claim 1, wherein the adhesive coating is repulpable for purposes of curbside recyclability.

3. The padded mailer of claim 1, wherein the inner shipping pocket includes an inner surface that is smooth and includes a plurality of holes formed by the plurality of standoffs.

4. The padded mailer of claim 1, wherein the inner shipping pocket is formed of a single piece of paper having the plurality of standoffs, such that the single piece of paper is folded along a bottom edge and sealed along a left edge and a right edge, and such that the second opening is formed along a top edge.

5. The padded mailer of claim 1, wherein the outer shipping pocket is formed of a single piece of paper, such that the single piece of paper is folded along a bottom edge and sealed along a left edge and a right edge, and such that the first opening is formed along a top edge.

6. The padded mailer of claim 1, wherein the plurality of standoffs are disposed along the inner shipping pocket in an array.

7. The padded mailer of claim 1, wherein the plurality of standoffs are formed by piercing through the inner shipping pocket.

8. The padded mailer of claim 1, wherein a shipping item is disposed within the inner shipping pocket.

9. The padded mailer of claim 8, wherein the outer shipping pocket includes a sealable flap, such that the first opening is configured to be sealed close.

10. A method of constructing a padded mailer, comprising:

receiving a single sheet of paper;

punching a plurality of standoffs into the single sheet of paper, wherein each of the plurality of standoffs comprises an aperture and material deformation beyond the aperture;

forming an inner shipping pocket with the single sheet of paper;

disposing the inner shipping pocket inside of an outer shipping pocket, wherein the plurality of standoffs from the inner shipping pocket are disposed away from an outer surface of the inner shipping pocket and towards an inner surface of the outer shipping pocket;

wherein the outer shipping pocket and the inner shipping pocket are comprised of curbside recyclable paper;

wherein the outer shipping pocket is coupled to the inner shipping pocket;

wherein the outer shipping pocket and inner shipping pocket are coupled by an adhesive coating; and wherein the adhesive coating is activated by heat.

11. The method of claim 10, further comprising deforming the plurality of standoffs after the plurality of standoffs have been punched.

12. The method of claim 10, wherein the plurality of standoffs are disposed along the inner shipping pocket in an array.

13. The method of claim 10, wherein the plurality of standoffs are all punched into the single sheet of paper in a first direction.

14. The method of claim 10, wherein the inner shipping pocket is formed of the single sheet of paper, such that the single sheet of paper is folded along a bottom edge and sealed along a left edge and a right edge, and such that an opening is formed along a top edge.

15. The method of claim 14, further comprising disposing a shipping item within the opening of the inner shipping pocket.

16. The method of claim 10, further comprising coupling the outer shipping pocket to the inner shipping pocket.

* * * * *